US005997372A

United States Patent [19]

Idzikowski et al.

[11] Patent Number: 5,997,372

[45] Date of Patent: Dec. 7, 1999

[54] MARINE PROPULSION DEVICE WITH AN IMPROVED LUBRICANT MANAGEMENT SYSTEM

[75] Inventors: George D. Idzikowski, Lomira; Steven J. Bethel, Oakfield, both of Wis.

[73] Assignee: Brunswick Corporation, Lake Forest, Ill.

[21] Appl. No.: 09/003,973

[22] Filed: Jan. 7, 1998

[51] Int. Cl.[6] ..... B63H 20/32

[52] U.S. Cl. ..... 440/88; 123/196 A; 184/6.24

[58] Field of Search ..... 440/88, 89; 123/196 A, 123/196 W; 184/6.24, 31

[56] References Cited

U.S. PATENT DOCUMENTS

| | | | |
|---|---|---|---|
| 4,523,556 | 6/1985 | Suzuki | 123/196 W |
| 4,735,590 | 4/1988 | Mondek | 440/88 |
| 4,828,519 | 5/1989 | Watanabe | 440/88 |
| 5,036,804 | 8/1991 | Shibata | 123/41.74 |
| 5,037,340 | 8/1991 | Shibata | 440/88 |
| 5,072,809 | 12/1991 | Shibata | 184/6.13 |
| 5,149,287 | 9/1992 | Koike | 440/88 |
| 5,163,394 | 11/1992 | Koishikawa et al. | 123/196 W |
| 5,215,164 | 6/1993 | Shibata | 184/6.13 |
| 5,439,404 | 8/1995 | Sumigawa | 440/88 |
| 5,640,936 | 6/1997 | Hudson | 123/196 W |

*Primary Examiner*—Jesus D. Sotelo
*Attorney, Agent, or Firm*—William D. Lanyi

[57] ABSTRACT

A four-cycle internal combustion engine is provided with a scavenge pump and a pressure pump that are both attached for rotation to a crank shaft of the engine. The inlets and outlets of the scavenge pump and pressure pump are located at positions within the structure of the internal combustion engine which inhibits the drainage of lubricant from a lubricant reservoir to the engine when the outboard motor is either tilted at an extreme angle from vertical or stored in a horizontal position. The scavenge pump and the pressure pump can be gerotor pumps and can either be located proximate each other at one side of the engine or displaced from each other on opposite sides of the engine.

15 Claims, 5 Drawing Sheets

MARINE PROPULSION DEVICE WITH AN IMPROVED LUBRICANT MANAGEMENT SYSTEM

BACKGROUND OF THE INVENTION

1. Field of the Invention

The present invention is generally related to a marine propulsion device and, more particularly, to an outboard motor with a lubricant management system that maintains a dry sump and a lubricant reservoir by utilizing two pumps which are both driven by the crank shaft of an internal combustion engine.

2. Description of the Prior Art

As is known to those skilled in the art, outboard motors which use four-cycle internal combustion engines present certain problems that are not inherent with two-cycle engines. Since four-cycle engines are, by their nature, larger than two-cycle engines of equivalent horsepower, the location of the sump requires particular care. For example, if the sump of the internal combustion engine is used to store the oil of the engine, placement of the sump within the crank shaft housing creates a particular problem because it places the oil close to the exhaust passages. This can create excessive temperatures in the oil within the sump and generally requires a cooling water system to maintain the oil temperature within acceptable magnitudes. If the sump is placed directly under the internal combustion engine and above the crank shaft housing, a four-cycle internal combustion engine would typically extend too high to be practical. In other words, the internal combustion engine and its cowling would extend significantly above the point about which the engine is intended to be rotated for trimming. If, on the other hand, the sump is located on the sides of the engine, it would be too wide and would likely obscure the boat operator's vision in the aft direction.

To solve these problems, it is well-known to those skilled in the art to provide the four-cycle internal combustion engine with a dry sump in combination with a lubricant reservoir. Oil that drains into the sump, under the influence of gravity, is pumped by a scavenge pump into the reservoir for future use. Another pump, referred to as a pressure pump, draws the lubricant from the reservoir and transmits it through a conduit to regions that require lubrication within the structure of the internal combustion engine. These principles are generally wellknown to those skilled in the art.

U.S. Pat. No. 4,523,556, which issued to Suzuki on Jun. 18, 1985, discloses a four-cycle internal combustion engine for outboard motors. Two embodiments of the lubricating system for four-cycle engines are described. Each of the systems embodies a lubricant sump that is disposed beneath the engine and to which lubricant is returned by gravity. In each of the two embodiments, a buffer volume is provided which receives lubricant when the engine is oriented in other than a desired position so that the oil will flow into the buffer volume rather than being discharged from the sump. The lubricant is returned to the engine from the buffer volume when the engine is again placed in its normal orientation. In one embodiment of this particular system, the buffer volume is provided by the cam shaft chamber of the engine.

U.S. Pat. No. 4,735,590, which issued to Mondek on Apr. 5, 1988, describes a lubrication system for a marine propulsion device. The marine propulsion device comprises a propulsion unit including an internal combustion engine, a pump driven by the engine, a transom bracket for mounting the propulsion unit to the transom of a boat, a fluid reservoir carried by the transom bracket, a fluid cooler carried by the transom bracket for cooling the fluid contained in the reservoir, and a conduit for communicating the cold oil to the pump.

U.S. Pat. No. 4,828,519, which issued to Watanabe on May 9, 1989, describes an outboard motor with an improved lubricating system for its internal combustion engine. The lubricant sump is positioned beneath the engine, and oil is returned to the sump through a drain opening in a spacer plate that separates the engine from the crank shaft housing. The oil sump and drain opening are configured so that oil will not return from the sump through the drain opening to the engine when the outboard motor is laid on its side edge.

U.S. Pat. No. 5,036,804, which issued to Shibata on Aug. 6, 1991, discloses a cooling system for a four-stroke outboard motor. The cooling system is used for a four-cycle internal combustion engine that is utilized as a power plant for an outboard motor. The cooling system is designed so that coolant is first delivered to cool an exhaust manifold in the cylinder block. Then the exhaust ports of the cylinder head and the other cylinder head components and then the cylinder block cooling jacket surrounding the cylinder bores.

U.S. Pat. No. 5,037,340, which issued to Shibata on Aug. 6, 1991, describes a lubricating device for a four-stroke outboard motor. A number of embodiments of outboard motors powered by four-cycle internal combustion engines have dry sump lubrication systems wherein the external oil reservoir is positioned externally of the engine. In some embodiments, the reservoir is contained directly in the power head and in other embodiments the reservoir is contained externally of the outboard motor. The use of external positioning of the lubricant reservoirs from the crank shaft housing permits the use of a large expansion chamber for the exhaust system in the crank shaft housing. In one embodiment, a pair of expansion chambers are provided.

U.S. Pat. No. 5,072,809, which issued to Shibata on Dec. 17, 1991, describes a lubricating device for a four-stroke outboard motor. The dry sump lubrication system includes a scavenge pump for drawing lubricant drained from the engine lubricating system through an inlet port and returning it to a dry sump reservoir through an outlet port and a pressure pump that draws lubricant from the dry sump lubricant reservoir through an inlet port and delivers it to the engine lubricating system through an outlet port. At least one of the ports of each of the pumps is positioned above the normal lubricant level in the lubricant reservoir when it is filled with the normal volume of lubricant so as to ensure that lubricant will not drain back into the engine when the pump system is not operating. Various arrangements for achieving this result and for cooling the lubricant system are described in U.S. Pat. No. 5,072,809.

U.S. Pat. No. 5,149,287, which issued to Koike on Sep. 22, 1992, describes a separate oiling system for an outboard motor. The lubricating system for an outboard motor has a lubricant delivery tank mounted on the outboard motor which is replenished by a pumping system from a separate lubricant storage tank contained within the hull of an associated watercraft. The circuit for controlling the pump includes a trim angle sensor which is mounted on the lubricant delivery tank for preventing operation of the pump when a trim angle change would incorrectly indicate a need for the addition of lubricant to the lubricant delivery tank.

U.S. Pat. No. 5,163,394, which issued to Koishikawa et. al. on Nov. 17, 1992, describes an engine with horizontal cylinders and an outboard engine assembly. The engine assembly includes a cylinder block with at least one horizontal cylinder defined therein, an oil pan disposed downwardly of the cylinder block, a cylinder head coupled to the cylinder block, and a head cover coupled to the cylinder head. The engine assembly also includes a valve operating mechanism chamber defined jointly between the cylinder head and the head cover, a lubricating oil supply passageway for supplying lubricating oil from the oil pan to at least the valve operating mechanism chamber, and a lubricating oil return passageway for returning lubricating oil from at least the valve operating mechanism chamber to the oil pan. The lubricating oil return passageway has openings for introducing lubricating oil from the valve operating mechanism chamber. The openings are defined in inner surfaces, respectively, of the cylinder head and the head cover which face a bottom of the valve operating mechanism chamber.

U.S. Pat. No. 5,215,164, which issued to Shibata on Jun. 1, 1993, discloses a lubricating device for a four-stroke outboard motor. The dry sump lubrication system includes a scavenge pump for drawing lubricant drained from the engine lubricating system through an inlet port and returning it to a dry sump reservoir through an outlet port and a pressure pump that draws lubricant from the dry sump lubricant reservoir through an inlet port and delivers it to the engine lubricating system through an outlet port. At least one of the ports in each of the pumps is positioned above the normal lubricant level in the lubricant reservoir when it is filled with the normal volume of lubricant so as to ensure that lubricant will not drain back into the engine when the pump system is not operating. Various arrangements for achieving this result and for cooling the lubricant are described in U.S. Pat. No. 5,215,164.

U.S. Pat. No. 5,439,404, which issued to Sumigawa on Aug. 8, 1995, describes a cooling system for an outboard motor. The lubricating reservoir bends into the crank shaft housing and is surrounded by an opening and is surrounded by an open trough-like manifold to which cooling water is delivered from the engine. This manifold has lower restricted openings that direct the coolant to the outer peripheral wall of the oil pan of the lubricant reservoir. The water level is maintained by a weir-like structure, and the water that overflows the weir is also directed toward the outer surface of the lubricant reservoir.

U.S. Pat. No. 5,640,936, which issued to Hudson on Jun. 24, 1997, discloses a removable oil reservoir for dry sump internal combustion engines. The removable oil tank and oil filter for a four-cycle dry sump internal combustion engine has particular utility in marine applications. A support for the tank is attached to or near the engine, and the oil tank is held in engagement with the support by mechanical quick disconnect retainers. Oil lines connecting the tank and the engine oil circulating system are connected by quick disconnect fluid connectors. One portion of the quick disconnect fluid connectors may be fixedly attached to a support for the tank in a position where they assist in supporting the oil tank when the connectors are joined.

The United States patents described immediately above are hereby incorporated by reference herein.

As is well known to those skilled in the art and described in the patents discussed above, it is common to provide a dry sump and a second lubricant reservoir for four-cycle internal combustion engines used in outboard motors. The inherently larger four-cycle engines, compared to two-cycle engines of similar power rating, require that the various components of the internal combustion engine be efficiently positioned to avoid making the outboard motor excessively high or wide. In addition, the lubricating oil must be maintained at a suitable temperature to avoid overheating or overcooling. The patents described above illustrate many different approaches known to the skilled artisan. In view of the prior art, it would be significantly beneficial if the scavenge pump and pressure pump could be advantageously located within the structure of the outboard motor to efficiently pump lubricant from the dry sump to the lubricant reservoir and from the lubricant reservoir to the regions of the internal combustion engine that require lubrication. It would also be significantly beneficial if the lubrication system could be constructed to take advantage of the efficiently located pressure and scavenge pumps while also avoiding the drainage of lubricant back into the engine when the outboard motor is tilted significantly from its normal operating position, either during use or when it is removed from a watercraft and stored.

SUMMARY OF THE INVENTION

A marine propulsion device made in accordance with the present invention comprises a power head that, in turn, comprises an internal combustion engine. The internal combustion engine includes a lubricating system and a sump into which a lubricant drains, under the influence of gravity, after lubricating certain preselected lubricated regions of the internal combustion engine. It also comprises a crank shaft that is driven by the internal combustion engine and is rotatably supported within a portion of the power head. A lubricant reservoir is provided and displaced from the sump for storing a buffer quantity of the lubricant. The quantity of lubricant in the reservoir has an upper surface location when the marine propulsion device is in normal use.

The marine propulsion device also comprises a pressure pump that is attached for rotation to the crank shaft of the internal combustion engine. It has a pressure pump inlet disposed in fluid communication with a portion of the lubricant reservoir below the upper surface of the lubricant and a pressure pump outlet disposed in fluid communication with the preselected lubricating regions of the internal combustion engine for transferring the lubricant from the lubricant reservoir to the preselected lubricated regions.

In addition, the propulsion device comprises a scavenge pump attached for rotation to the crank shaft. The scavenge pump has a scavenge pump inlet which is disposed in fluid communication with the sump of the internal combustion engine and a scavenge pump outlet disposed in fluid communication with the lubricant reservoir at a location above the upper surface of the lubricant for transferring the lubricant from the sump to the lubricant reservoir.

In order to facilitate the operation of the lubrication system, a vent is connected between and in fluid communication with the lubricant reservoir and with the crankcase of the internal combustion engine.

In one embodiment of the present invention, the pressure pump and the scavenge pump are disposed proximate each other at a common side of the internal combustion engine. In an alternative embodiment, the pressure pump and the scavenge pump are displaced from each other at opposite sides of the internal combustion engine. The choice of embodiment of the present invention depends on the particular application of the lubrication system.

The marine propulsion device of the present invention is intended for use with a four-cycle internal combustion engine used in an outboard motor. The pressure pump and the scavenge pump can be gerotor pumps.

BRIEF DESCRIPTION OF THE DRAWINGS

The present invention will be more fully and completely understood from a reading of the description of the preferred embodiment in conjunction with the drawings, in which.

DESCRIPTION OF PREFERRED EMBODIMENT

Figure 1:
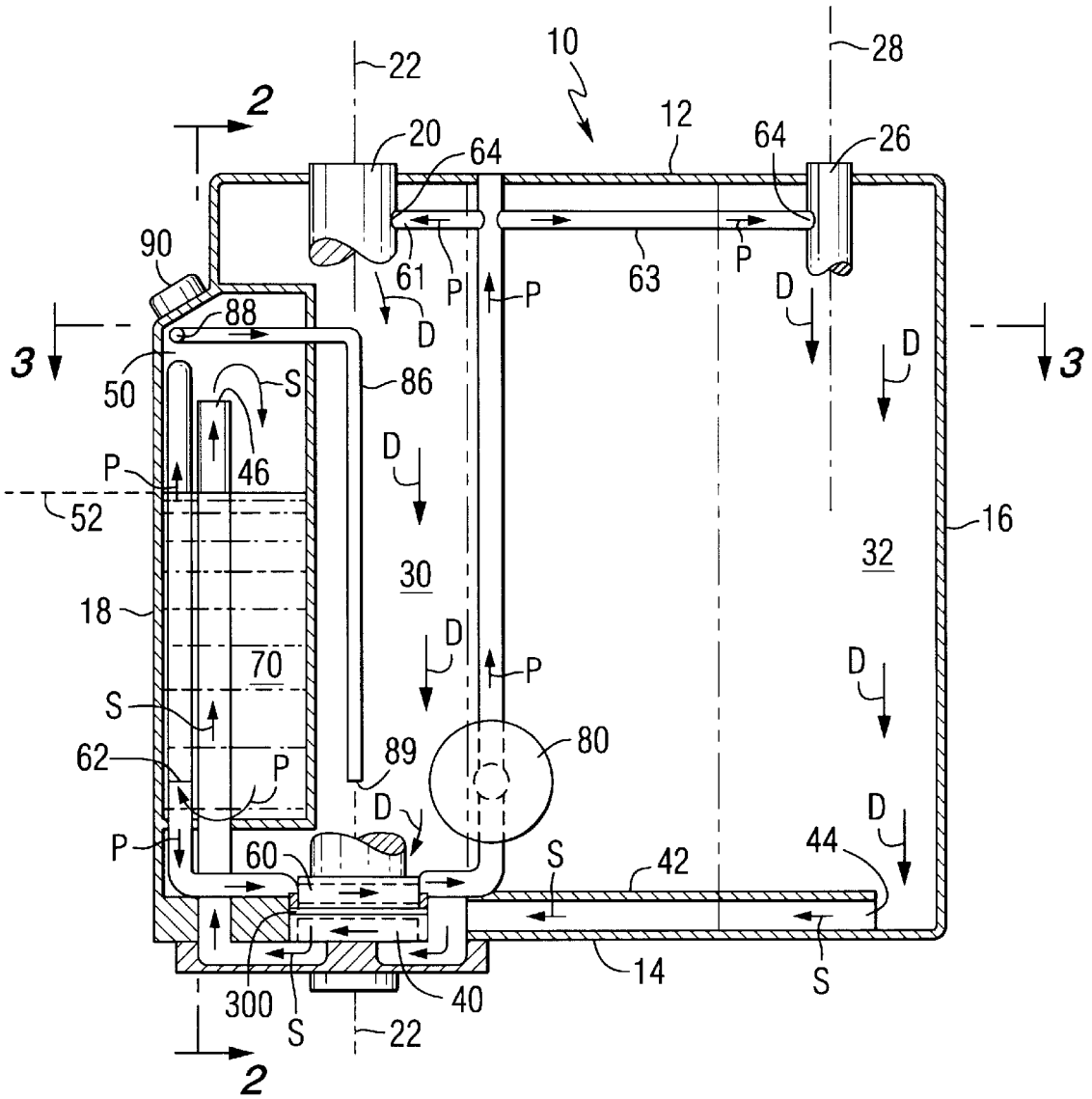
FIG. 1 is a side sectional view of a first embodiment of the present invention.

Throughout the description of the preferred embodiment of the present invention, like components will be identified by like reference numerals.

FIG. 1 shows a side section view of an internal combustion engine used as the power head for an outboard motor. The view is highly schematic, and many parts of the internal combustion engine are intentionally not shown in FIG. 1 for the purpose of clarity so that the figure can more clearly illustrate the primary components of the present invention. The internal combustion engine 10, when in normal use, has a top 12, a bottom 14, a front 16 and a back 18. A crank shaft 20 extends vertically and rotates about centerline 22 in response to the operation of the internal combustion engine 10. A cam shaft 26 also extends vertically and rotates about centerline 28. The portion of the outboard motor illustrated in FIG. 1 defines the power head. The internal combustion engine has a lubricating system in order to provide lubricant to preselected lubricated regions of the internal combustion engine.

In FIG. 1, it should be understood that a plurality of pistons are disposed in the region between the crank shaft 20 and the cam shaft 26 for reciprocation in a horizontal direction. The crankcase of the internal combustion engine is located in the vicinity identified by reference numeral 30, and the cams, which are attached to the cam shaft 26, are located in the region identified by reference numeral 32. After lubricant is provided to the preselected lubricated regions of the internal combustion engine, it drains under the influence of gravity toward the sump at the bottom portion of the engine. Arrows D in FIG. 1 represent the drainage of the lubricant toward the sump. A scavenge pump 40 draws the lubricant from the bottom portion, or sump, of the internal combustion engine 10 and causes it to flow into and through conduit 42. The scavenge pump inlet 44 is disposed in fluid communication with the sump of the internal combustion engine. The scavenge pump outlet 46 is disposed in fluid communication with a lubricant reservoir 50 at a location above an upper surface 52 of a quantity of lubricant stored in the lubricant reservoir 50. Arrows S indicate the flow of lubricant from the scavenge pump inlet 44 to the scavenge pump outlet 46 under the influence of the scavenge pump 40. The scavenge pump 40 is rigidly attached to the crank shaft 20 and its rotor rotates in unison with the crank shaft.

A pressure pump 60 causes lubricant to flow from the pressure pump inlet 62, as represented by arrows P, to the pressure pump outlets 64 located proximate and in fluid communication with preselected lubricated regions of the internal combustion engine. For purpose of illustration, the pressure pump outlets 64 are shown at locations near the crank shaft 20 and the cam shaft 26, but it should be clearly understood that many different outlets can be provided to lubricate a plurality of lubricated regions of the engine. The pressure pump 60 is attached for rotation to the crank shaft 20 and has a pressure pump inlet 62 disposed in fluid communication with a portion of the lubricant reservoir 50 below the upper surface 52 of the lubricant 70 within the reservoir 50. The pressure pump 60 also has at least one pressure pump outlet 64 disposed in fluid communication with the one or more preselected lubricated regions of the internal combustion engine. The purpose of the pressure pump 60 is to transfer lubricant from the lubricant reservoir 50 to the preselected lubricated regions.

In the embodiment shown in FIG. 1, the scavenge pump 40 and the pressure pump 60 are disposed proximate each other and are both attached for rotation to the crank shaft 20. The two pumps are disposed at a common side of the internal combustion engine. In other words, both of the pumps are at the bottom portion of the internal combustion engine and located at a common side with respect to the location of the pistons of the engine. An oil filter 80 is connected in fluid communication between the pressure pump 60 and its pressure pump outlets 64.

A vent 86 is connected between the lubricant reservoir 50 and the crankcase region of the engine. A first end 88 of the vent 86 is disposed at a location within the reservoir 50 above the upper surface 52 of the lubricant 70. The second end 89 of the vent 86 is disposed at a region near the bottom of the crankcase 30. A filler cap 90 is provided to permit additional lubricant to be added to the reservoir 50 when needed.

With continued reference to FIG. 1, several characteristics of the lubricating system should be noted. The pressure pump inlet 62 is located near the bottom of the reservoir 50 to assure that it is under the upper surface 52 even if the outboard motor is tilted at an extreme angle from vertical. In addition, the inlet 44 of the scavenge pump 40 is located at the bottom portion of the internal combustion engine in order to allow the oil in the sump to be drawn from the sump and transferred to the reservoir 50. The scavenge pump outlet 46 is disposed above the upper surface 52 of the lubricant 70 within the reservoir 50. The first end 88 of the vent 86 is disposed above the upper surface 52 of the lubricant 70 and the second end 89 of the vent 86 is disposed at the bottom region of the crankcase 30.

Figure 2:
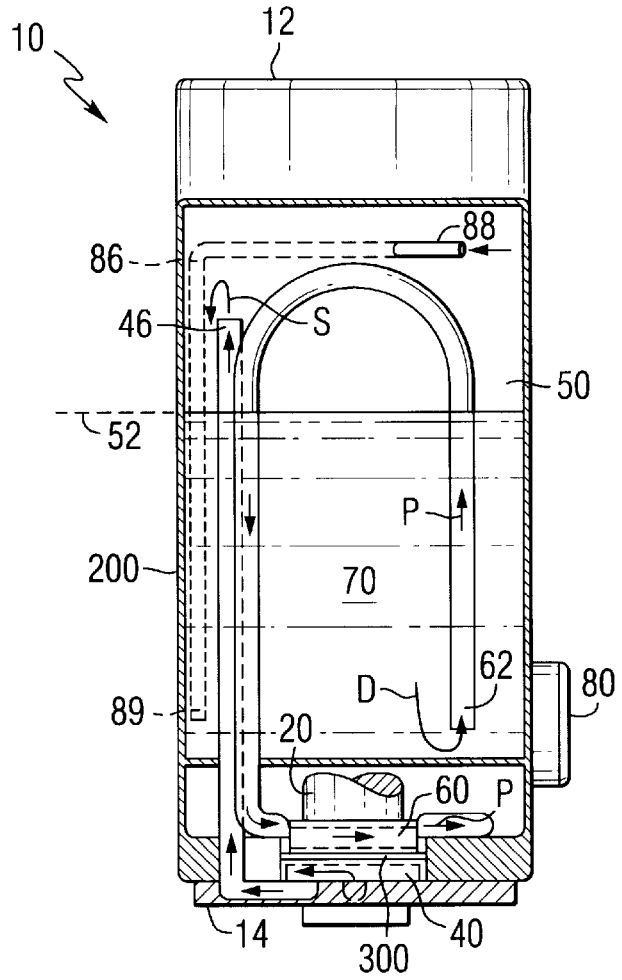
FIG. 2 is a front sectional view of a first embodiment of the present invention.

FIG. 2 is a front sectional view of the internal combustion engine shown in FIG. 1. The scavenge pump transfers oil to the reservoir 50 through the scavenge pump outlet 46 which is located above the upper surface 52 of the lubricant 70. The pressure pump 60 draws lubricant from the pressure pump inlet 62 and transfers it, as represented by arrows P, through the oil filter 80 and to the preselected lubricated regions of the engine. The vent 86 has its first end 88 disposed within the reservoir 50 to allow equalization of pressure between the inside of the reservoir 50 and the second end 89 of the vent 86 disposed within the crankcase 30.

With reference to FIGS. 1 and 2, it can be seen that the first end 88 of the vent 86 is located at the upper right corner of the reservoir 50 in FIG. 2 and near the front 18 of the reservoir 50 in FIG. 1. Furthermore, the second end 89 of the vent 86 is shown at the lower left corner of the reservoir 50 in FIG. 2 and at a position toward the right of the reservoir 50 in FIG. 1. As will be described in greater detail below, the configuration of the vent 86 is useful in avoiding inadvertent draining of lubricant from the reservoir 70 into the engine when the outboard motor is stored or tilted at an extreme angle from vertical.

Figure 3:
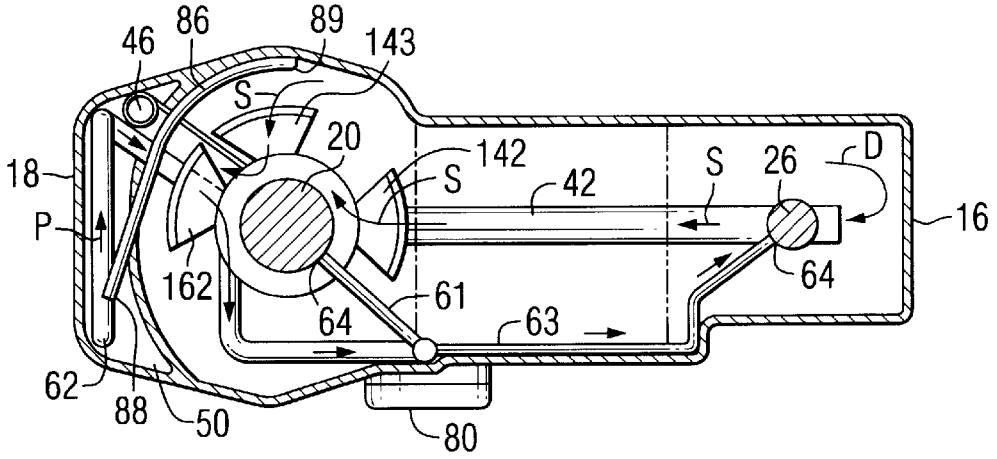
FIG. 3 is a top sectional view of a first embodiment of the present invention.

FIG. 3 is a section view of FIG. 1. In FIG. 3, reference numeral 142 represents the scavenge pump inlet from the cylinder head region of the engine, and reference numeral 143 represents the scavenge pump inlet from the crankcase region 30 of the engine. Reference numeral 162 represents the pressure pump inlet port.

With reference to FIGS. 1, 2 and 3, it can be seen that the vent 86 has its first end 88 positioned within the reservoir 50, and its second end 89 displaced from the first end 88 by a considerable magnitude in all three figures. This places the first and second ends, 88 and 89, of the vent 86 at positions so that oil will not drain from the reservoir 50 into the engine when the outboard motor is tilted at an extreme angle from vertical or stored in a horizontal position. This can be seen by imagining that the engine is stored in a horizontal configuration on its front 18 surface. The lubricant 70 would naturally settle in the front portion of the reservoir 50 and would likely cover the scavenge pump outlet 46 beneath the upper surface of the lubricant. In addition, the first end 88 of the vent 86 would also be below the surface of the lubricant. However, the scavenge pump inlet 44 would be above the upper surface of the lubricant. The second end 89 of the vent 86 would also be above the upper surface of the lubricant. Therefore, no drainage of lubricant would occur from the reservoir 50 into the engine compartment. If the engine 10 is stored on its port side 200, the upper surface of the lubricant would likely be above the second end 89 of the vent 86 and the scavenge pump outlet 46. However, the first end 88 of the vent 86 would be above the upper surface as would the scavenge pump inlet 44. The pressure pump inlet 62 would also be above the upper surface. By comparing FIGS. 1, 2 and 3 to each other, it can be seen that oil will not drain from the reservoir 50 to the other portions of the engine when the outboard motor is tilted at an extreme angle from vertical or stored in a horizontal position on any of its four sides.

With continued reference to FIGS. 1, 2 and 3, it should be noted that dry sump lubricating systems require two pumps to be included within the system. The scavenge pump 40 transfers oil from the bottom portion of the sump to the lubricant reservoir 50. The second pump, the pressure pump 60, transfers oil from the bottom region of the reservoir 50 to various preselected lubricated portions of the engine. From those lubricated portions, the lubricant drains to the sump of the engine to be transferred again by the scavenge pump 40 to the reservoir 50. The embodiment of the present invention illustrated in FIGS. 1, 2 and 3 attaches both the scavenge pump 40 and the pressure pump 60 to the crank shaft 20 for rotation therewith. This technique avoids the need for additional power takeoff shafts which are connected to the crank shaft for the purpose of driving either one or both of the pumps. It also allows for a compact structure which locates both of the pumps within the internal combustion engine with very little use of space. Naturally, the direct attachment of the scavenge pump and pressure pump to the crank shaft 20 eliminates the need for additional shafts and gears to transmit power from the crank shaft 20 to the two pumps. The attachment of the two pumps directly to the crank shaft represents a significant improvement over the known arrangements for providing the scavenge pump and pressure pump for a four-cycle internal combustion engine used as a power head for an outboard motor.

The scavenge pump 40 and pressure pump 60 illustrated in FIGS. 1, 2 and 3 are gerotor pumps in a preferred embodiment of the present invention. Between the to gerotor pumps, a steel plate 300 is disposed to provide a fluid seal between the pumps and prevent fluid communication between the pressure pump 60 and the scavenge pump 40.

Figure 4:
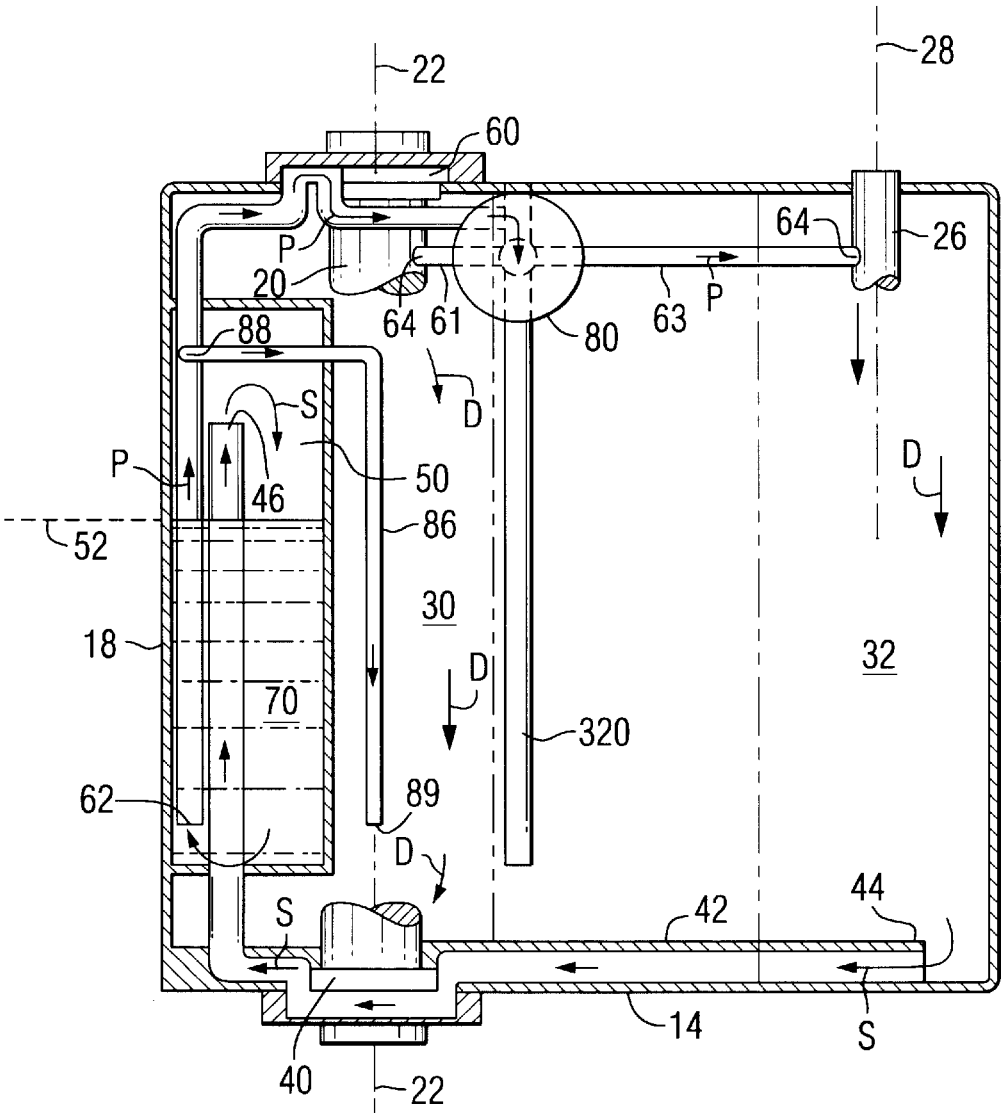
FIG. 4 is a side sectional view of a second embodiment of the present invention.
Figure 5:
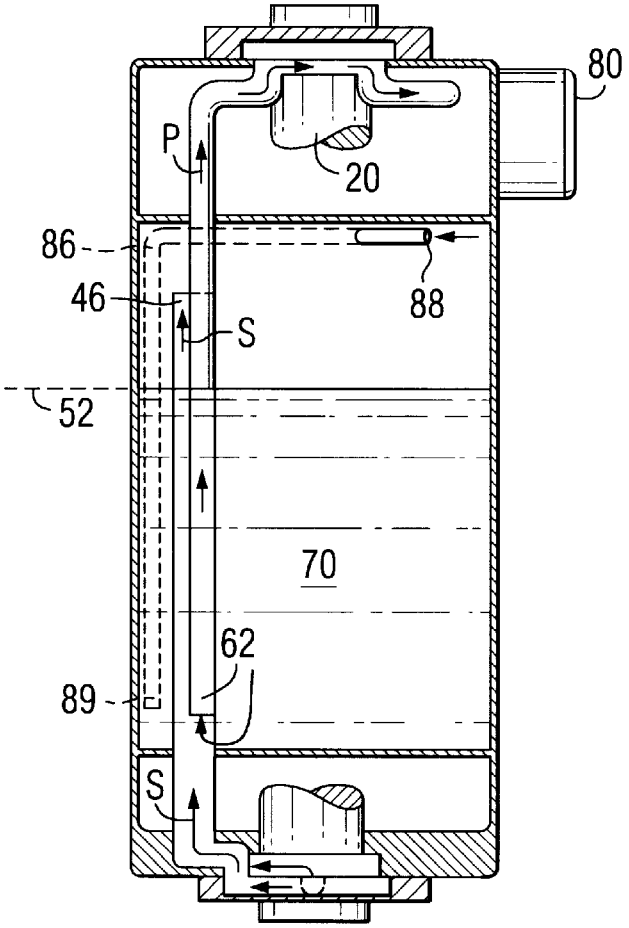
FIG. 5 is a front sectional view of a second embodiment of the present invention.
Figure 6:
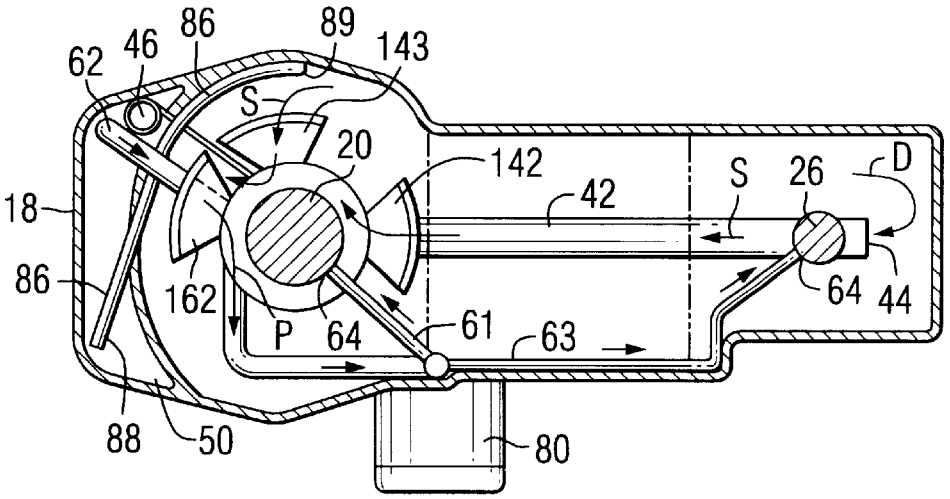
FIG. 6 is a top sectional view of a second embodiment of the present invention.

FIGS. 4, 5 and 6 are analogous to FIGS. 1, 2 and 3, but show an alternative embodiment of the present invention. All of the components in FIGS. 4, 5 and 6 are also present in FIGS. 1, 2 and 3, but the pressure pump 60 is located at the upper end of the crank shaft 22 as illustrated in FIG. 4. Rather than place the pressure pump 60 and the scavenge pump 40 proximate each other at a common side of the engine. The embodiment shown in FIGS. 4, 5 and 6 separates the two pumps and places the scavenge pump 40 and the pressure pump 60 at opposite sides of the engine. This necessitates certain changes in the conduits used as the pressure pump inlet and pressure pump outlet. For example, rather than have a U-shaped inlet tube for the pressure pump 60 as illustrated in FIG. 2, a conventional conduit extends from the pressure pump into the reservoir 50 in order to locate the pressure pump inlet 62 at a position near the bottom of the reservoir. In addition, the oil filter 80 is moved to a location near the upper portion of the internal combustion engine which is closer to the pressure pump 60. As in the initial embodiment illustrated in FIG. 1, the oil filter 80 is located between the pressure pump 60 and the pressure pump outlets 64. Although conduit 320 is illustrated as having only two branch conduits, 61 and 62, extending from it, it should be understood that other branches would typically be provided for the purpose of conducting the lubricant to other lubricated regions of the internal combustion engine.

Other than the differences regarding the location of the pressure pump 60 and its related conduits, all other attributes of the present invention are similar in both embodiments of the present invention.

Figure 7:
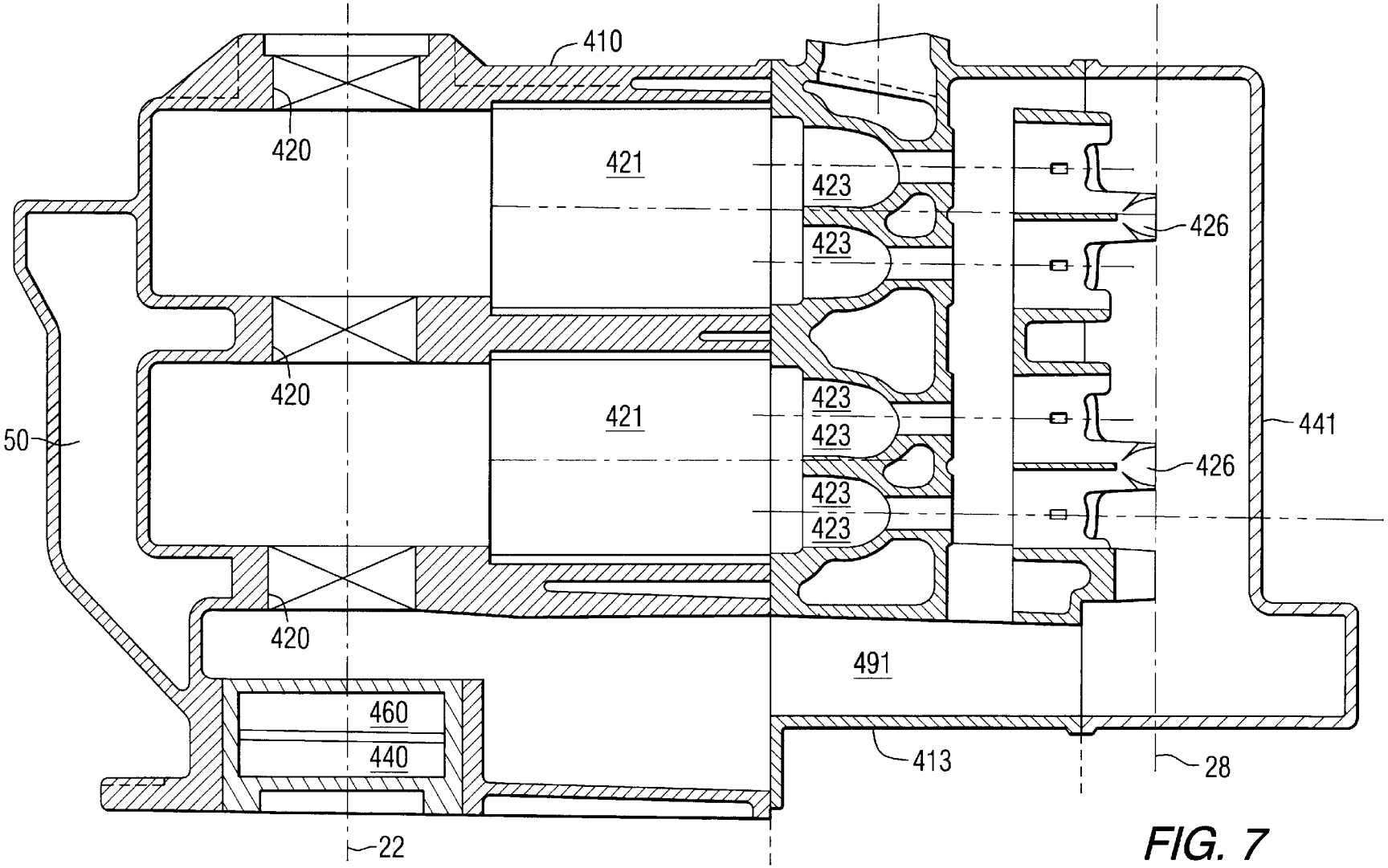
FIG. 7 is a sectional view of an engine block, a head and a cover of an internal combustion engine suitable for use with the first embodiment of the present invention.

FIG. 7 is a section view of an internal combustion engine for use with the first embodiment of the present invention as described above in conjunction with FIGS. 1, 2 and 3. FIG. 7 represents a section view of an engine block and cylinder head which is suitable for combination with the present invention. The engine block 410 has the reservoir 50 formed as an integral part of the engine block. In FIG. 7, centerline 22 is shown to represent the location where the crank shaft 20 would be supported by bearings 420. In addition, the pressure pump 60 would be located in region 460 in FIG. 7, and the scavenge pump 40 would be located in region 440 in FIG. 7. The cylinder head 413 is attached to the engine block 410 and provides the locations where the valves and other components would be located. Pistons would be located in regions 421 and would be connected by connecting rods to the crank shaft 20. Valves would be disposed in regions 423, and the cam shaft 26 would be supported in bearings 426. A cover 441 provides protection for the cam shaft and its associated cams which would be aligned with the regions 423 in which the valves are disposed.

With continued reference to FIG. 7, the space 491 is intended to allow a torque transmitting connection, such as a drive chain, to be made between the crank shaft 22 and the cam shaft 26. It also defines the sump of the engine. Naturally, although the present invention has been described with particular detail and illustrated to show two preferred embodiments of the present invention, alternative embodiments are also within its scope.

I claim:

1. An marine propulsion device, comprising:

a power head comprising an internal combustion engine, said internal combustion engine comprising a lubricating system and a sump into which a lubricant drains under the influence of gravity after lubricating preselected lubricated regions of said internal combustion engine;

a crank shaft driven by said internal combustion engine and rotatably supported within a portion of said power head;

a lubricant reservoir displaced from said sump for storing a quantity of said lubricant, said quantity of lubricant having an upper surface when said marine propulsion device is in normal use;

a pressure pump attached for rotation to said crank shaft, said pressure pump having a pressure pump inlet disposed in fluid communication with a portion of said lubricant reservoir below said upper surface and a pressure pump outlet disposed in fluid communication with said preselected lubricated regions of said internal combustion engine for transferring said lubricant from said lubricant reservoir to said preselected lubricated regions;

a scavenge pump attached for rotation to said crank shaft, said scavenge pump having a scavenge pump inlet disposed in fluid communication with said sump of said internal combustion engine and a scavenge pump outlet disposed in fluid communication with said lubricant reservoir at a location above said upper surface for transferring said lubricant from said sump to said lubricant reservoir; and a vent connected between and in fluid communication with said lubricant reservoir and a crankcase of said internal combustion engine said pressure pump and said scavenge pump being disposed proximate each other at a common side of said internal combustion engine.

2. The marine propulsion device of claim 1, where in:

said pressure pump and said scavenge pump are displaced from each other at opposite sides of said internal combustion engine.

3. The marine propulsion device of claim 1, wherein:

said internal combustion engine is a four cycle engine.

4. The marine propulsion device of claim 1, wherein:

said marine propulsion device is an outboard motor.

5. The marine propulsion device of claim 1, wherein:

said pressure pump is a gerotor pump.

6. The marine propulsion device of claim 1, wherein:

said scavenge pump is a gerotor pump.

7. An marine propulsion device, comprising:

a power head comprising an internal combustion engine, said internal combustion engine comprising a lubricating system and a sump into which a lubricant drains under the influence of gravity after lubricating preselected lubricated regions of said internal combustion engine;

a crank shaft driven by said internal combustion engine and rotatably supported within a portion of said power head;

a lubricant reservoir displaced from said sump for storing a quantity of said lubricant, said quantity of lubricant having an upper surface when said marine propulsion device is in normal use;

a pressure pump attached for rotation to said crank shaft, said pressure pump having a pressure pump inlet disposed in fluid communication with a portion of said lubricant reservoir below said upper surface and a pressure pump outlet disposed in fluid communication with said preselected lubricated regions of said internal combustion engine for transferring said lubricant from said lubricant reservoir to said preselected lubricated regions;

a scavenge pump attached for rotation to said crank shaft, said scavenge pump having a scavenge pump inlet disposed in fluid communication with said sump of said internal combustion engine and a scavenge pump outlet disposed in fluid communication with said lubricant reservoir at a location above said upper surface for transferring said lubricant from said sump to said lubricant reservoir; and a vent connected between and in fluid communication with said lubricant reservoir and a crankcase of said internal combustion engine.

8. The marine propulsion device of claim 7, wherein:

said pressure pump and said scavenge pump are disposed proximate each other at a common side of said internal combustion engine.

9. The marine propulsion device of claim 7, wherein:

said pressure pump and said scavenge pump are displaced from each other at opposite sides of said internal combustion engine.

10. The marine propulsion device of claim 7, wherein:

said internal combustion engine is a four cycle engine.

11. The marine propulsion device of claim 7, wherein:

said marine propulsion device is an outboard motor.

12. The marine propulsion device of claim 7, wherein:

said pressure pump is a gerotor pump and said scavenge pump is a gerotor pump.

13. An marine propulsion device, comprising:

a power head comprising an internal combustion engine, said internal combustion engine comprising a lubricating system and a sump into which a lubricant drains under the influence of gravity after lubricating preselected lubricated regions of said internal combustion engine;

a crank shaft driven by said internal combustion engine and rotatably supported within a portion of said power head;

a lubricant reservoir displaced from said sump for storing a quantity of said lubricant, said quantity of lubricant having an upper surface when said marine propulsion device is in normal use;

a pressure pump attached for rotation to said crank shaft, said pressure pump having a pressure pump inlet disposed in fluid communication with a portion of said lubricant reservoir below said upper surface and a pressure pump outlet disposed in fluid communication with said preselected lubricated regions of said internal combustion engine for transferring said lubricant from said lubricant reservoir to said preselected lubricated regions;

a scavenge pump attached for rotation to said crank shaft, said scavenge pump having a scavenge pump inlet disposed in fluid communication with said sump of said internal combustion engine and a scavenge pump outlet disposed in fluid communication with said lubricant reservoir at a location above said upper surface for transferring said lubricant from said sump to said lubricant reservoir; and a vent connected between and in fluid communication with said lubricant reservoir and a crankcase of said internal combustion engine, said internal combustion engine being a four cycle engine and said marine propulsion device being an outboard motor, said pressure pump being a gerotor pump and said scavenge pump being a gerotor pump.

14. The marine propulsion device of claim 13, wherein:

said pressure pump and said scavenge pump are disposed proximate each other at a common side of said internal combustion engine.

15. The marine propulsion device of claim 13, wherein:

said pressure pump and said scavenge pump are displaced from each other at opposite sides of said internal combustion engine.

* * * * *